US010125004B2

(12) United States Patent
Li et al.

(10) Patent No.: US 10,125,004 B2
(45) Date of Patent: Nov. 13, 2018

(54) LIQUID INJECTING CONTAINER

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Changzheng Dai, Shenzhen (CN); Xingbing Zou, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 106 days.

(21) Appl. No.: 15/273,673

(22) Filed: Sep. 22, 2016

(65) Prior Publication Data

US 2017/0006915 A1 Jan. 12, 2017

(30) Foreign Application Priority Data

Oct. 23, 2015 (CN) ..... 2015 2 0823531 U

(51) Int. Cl.
*B67D 3/02* (2006.01)
*B67D 3/00* (2006.01)
*A24F 47/00* (2006.01)

(52) U.S. Cl.
CPC ..... *B67D 3/0025* (2013.01); *A24F 47/004* (2013.01)

(58) Field of Classification Search
CPC ..... B67D 3/02; B67D 3/0025
USPC ..... 141/351–353, 363–366
See application file for complete search history.

(56) References Cited

U.S. PATENT DOCUMENTS 2,989,091 A * 6/1961 Lowenthal ..... F23Q 2/52 141/18
3,174,519 A * 3/1965 Pizzurro ..... F23Q 2/52 141/295
3,402,747 A * 9/1968 Tissot-Dupont ..... F17C 13/04 137/614
3,574,314 A * 4/1971 Quercia ..... F23Q 2/52 137/517
4,356,848 A * 11/1982 Spies ..... B65B 3/06 141/321
4,393,894 A * 7/1983 Mol ..... B41L 23/14 118/401

(Continued)

FOREIGN PATENT DOCUMENTS

GB 1016334 A * 1/1966 ..... B67D 1/0835

*Primary Examiner* — Timothy L Maust
(74) *Attorney, Agent, or Firm* — Cheng-Ju Chiang

(57) ABSTRACT

The present disclosure relates to a liquid injecting container for an atomizer. The atomizer includes a liquid injecting opening. The liquid injecting container includes a housing, a movable piece, and an elastic piece. The housing defines a reservoir for storing tobacco liquid. The housing has an open end. The open end defines at least one liquid outlet. The movable piece is capable of moving along an axial direction of the open end. The elastic piece abuts against the movable piece. When the open end is coupled to the liquid injecting opening, the movable piece is capable of moving axially to a first position where the at least one liquid outlet is opened. When the open end is detached from the atomizer, the elastic piece is capable of driving the movable piece to move axially to a second position where the at least one liquid outlet is sealed.

10 Claims, 4 Drawing Sheets

(56) References Cited

U.S. PATENT DOCUMENTS

| | | | | | |
|---|---|---|---|---|---|
| 5,154,212 | A * | 10/1992 | Weber | A47K 5/13 | 141/353 |
| 5,687,777 | A * | 11/1997 | Dobson | A61M 16/183 | 141/18 |
| 6,131,774 | A * | 10/2000 | Thomas | G01F 11/282 | 222/181.2 |
| 9,216,889 | B2 * | 12/2015 | Morayko | B65D 47/248 | |
| 9,828,229 | B2 * | 11/2017 | Yang | B67D 3/0035 | |
| 2016/0332754 | A1 * | 11/2016 | Brown | B65B 3/10 | |
| 2018/0029867 | A1 * | 2/2018 | Biel | B67D 7/0294 | |

* cited by examiner

LIQUID INJECTING CONTAINER

TECHNICAL FIELD

The present invention relates to a liquid injecting container.

BACKGROUND ART

A refillable electronic cigarette is becoming more and more popular because it is environmental-friendly. When tobacco liquid in the refillable electronic cigarette is used up, the user of the electronic cigarette usually uses an injector to fill in tobacco liquid. However, during this process, the tobacco liquid may leak out. For example, since the injector is not fixedly coupled with the electronic cigarette, the tobacco liquid may leak when the electronic cigarette is turned over, thus rendering user experience unsatisfactory.

What is needed, therefore, is a liquid injecting container, which can overcome the above shortcomings.

SUMMARY

The present disclosure relates to a liquid injecting container for an atomizer. The atomizer includes a liquid injecting opening. The liquid injecting container includes a housing, a movable piece, and an elastic piece. The housing defines a reservoir for storing tobacco liquid. The housing has an open end. The open end defines at least one liquid outlet. The movable piece is capable of moving along an axial direction of the open end. The elastic piece abuts against the movable piece. When the open end is coupled to the liquid injecting opening, the movable piece is capable of moving axially to a first position where the at least one liquid outlet is opened. When the open end is detached from the atomizer, the elastic piece is capable of driving the movable piece to move axially to a second position where the at least one liquid outlet is sealed.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
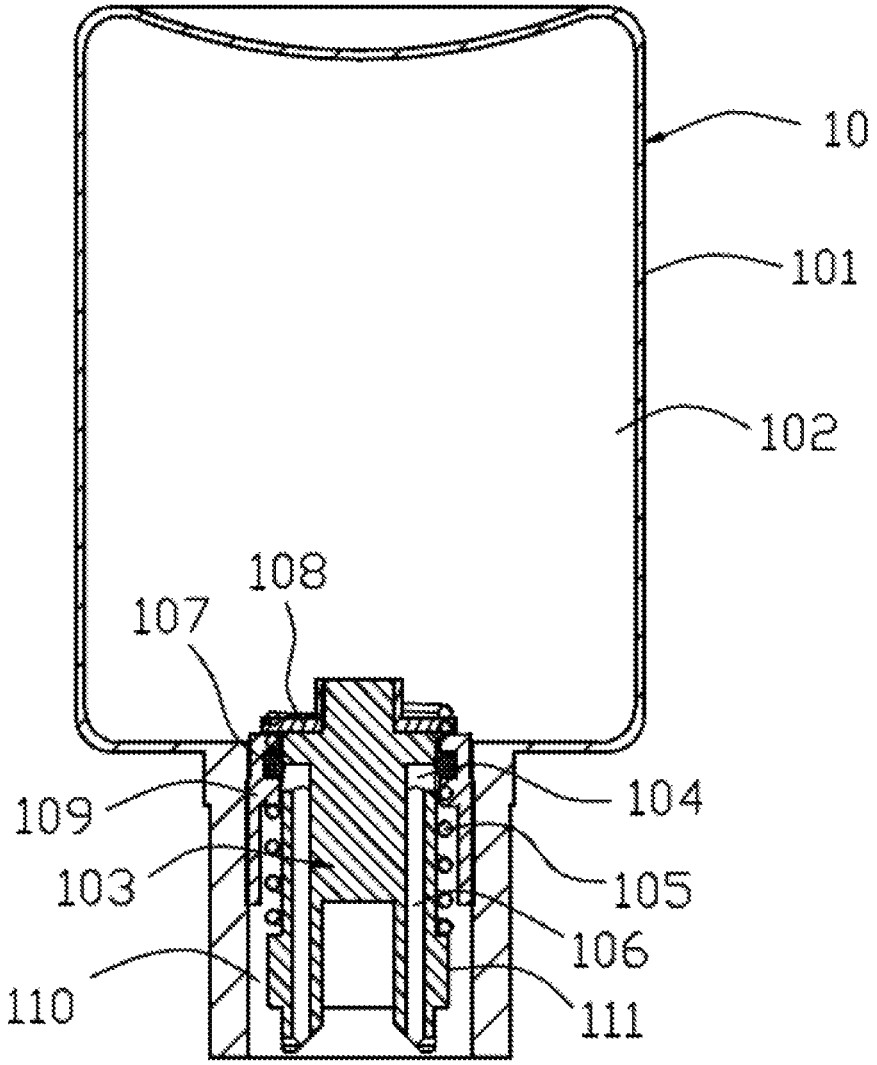
FIG. 1 is a cross-sectional view of a liquid injecting container including a liquid outlet according to an embodiment, when the liquid outlet is sealed.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Referring to FIG. 1, a liquid injecting container 10 includes a housing 101 having an open end 110, a movable piece 103 in the open end 110, and an elastic piece 105 in the open end 110. The housing 101 defines a reservoir 102 configured (i.e., structured and arranged) for storing tobacco liquid. The open end 110 is configured for connecting with a liquid injecting opening 201 of an atomizer 20 (Both referring to FIG. 4) of an electronic cigarette. The open end 110 defines at least one liquid outlet 104. The movable piece 103 is received in the open end 110, and is capable of moving along an axial direction of the open end 110 upon an external force. In the present embodiment, the elastic piece 105 is a spring. The elastic piece 105 abuts against the movable piece 103.

When the open end 110 is connected with the injecting opening 201 of the atomizer 20, the atomizer 20 pushes the movable piece 103 to move axially, so that the liquid outlet 104 is opened. When the open end 110 is separated from the atomizer 20, the movable piece 103 is capable of returning to its original position where the liquid outlet 104 is sealed, thus avoiding liquid leakage.

Quite usefully, the liquid outlet 104 is defined in an upper part of a sidewall of the movable piece 103, and the movable piece 103 defines at least one liquid passage 106 extending along an axial direction. The liquid passage 106 is in communication with the liquid outlet 104. In the present embodiment, the liquid outlet 104 includes two symmetric through holes defined in the sidewall, and the movable piece 103 defines two liquid passages 106. When the movable piece 103 is moved up or down along the axial direction, the liquid outlet 104 is selectively in communication with the reservoir 102.

To improve sealing effect, a sealing component 107 is arranged between the movable piece 103 and the open end 110. The sealing component 107 is configured for sealing the liquid outlet 104. When the movable piece 103 is moved upwards and beyond the sealing component 107, the liquid outlet 104 is in communication with the reservoir 102. When the injecting container 10 is not used, the liquid outlet 104 is positioned below the sealing component 107, the sealing component 107 and a sidewall of the movable piece 103 cooperatively seals the liquid outlet 104. It is to be understood that the movable piece 103 may be made of elastic material, which has sealing effect.

To assemble the sealing component 107, a holder 109 is provided inside the open end 110. The holder 109 is engaged in the open end 110 by interference fit. In the present embodiment, the sealing component 107 is a sealing ring. The holder 109 defines an annular groove, and the sealing ring is engaged in the annular groove, so that the sealing ring will not be driven to move by the movable piece 103. It is to be understood that in other embodiments, the holder 109 may be made of elastic material.

Figure 3:
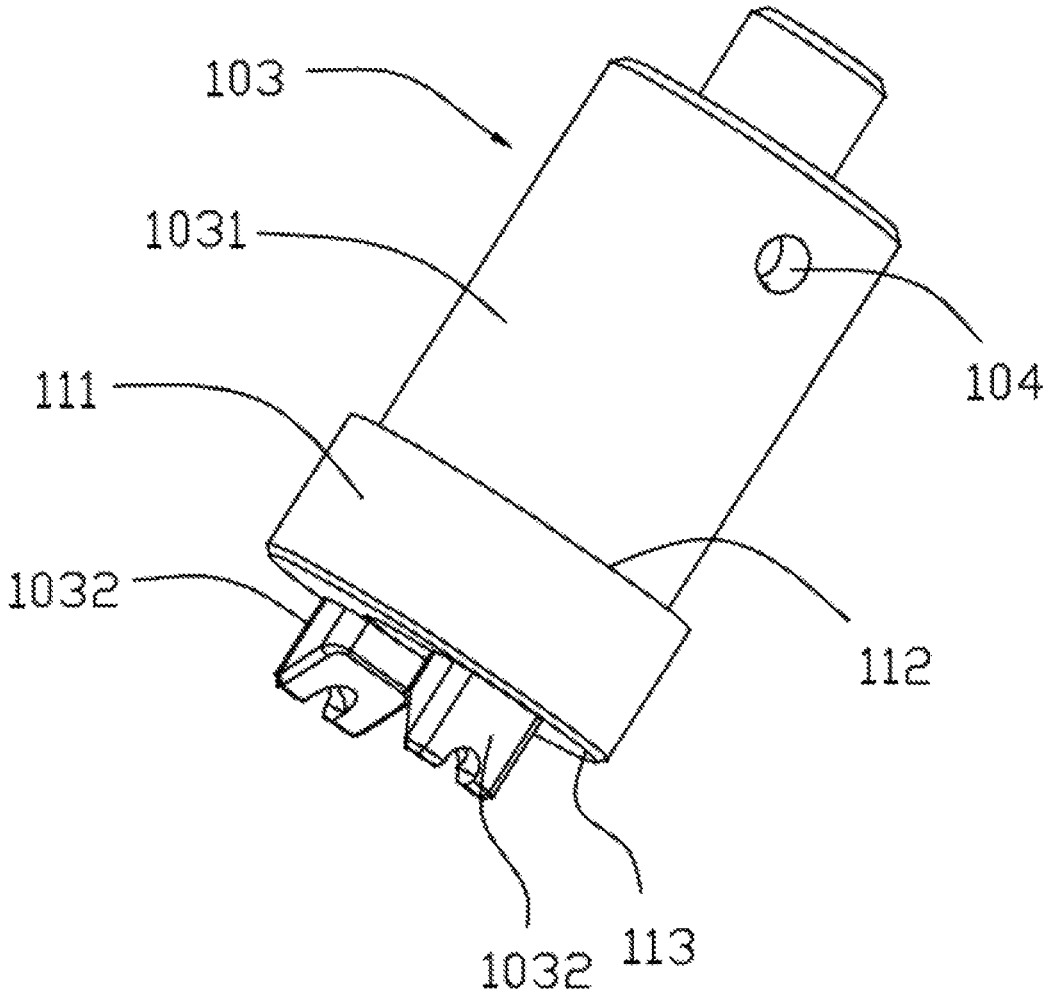
FIG. 3 is a perspective view of a movable piece of the liquid injecting container of FIG. 1.

Referring to FIGS. 1 and 3, the movable piece 103 is substantially cylindrical, and includes a main body 1031 and at least one inserting part 1032 extending from the main body 1031. The at least one inserting part 1032 is configured for inserting into the injecting opening 201 of the atomizer 20. In the present embodiment, the at least one inserting part 1032 includes two inserting parts 1032, and each liquid passage 106 extends through a corresponding inserting part 1032.

A locating plate 108 is fixedly mounted on a top of the movable piece 103. An end of the spring is connected to the locating plate 108, and a part of the spring abuts against the holder 109. When the movable piece 103 is pushed upwards, an upper part of the spring is stretched. Also referring to FIG. 3, the movable piece 103 includes a flange 111 on a sidewall. During liquid injection process, a lower surface 113 of the flange 111 is configured for abutting against the atomizer 20. The spring nests the movable piece 103, and a lower end of the spring abuts against an upper surface 112 of the flange 111.

Figure 2:
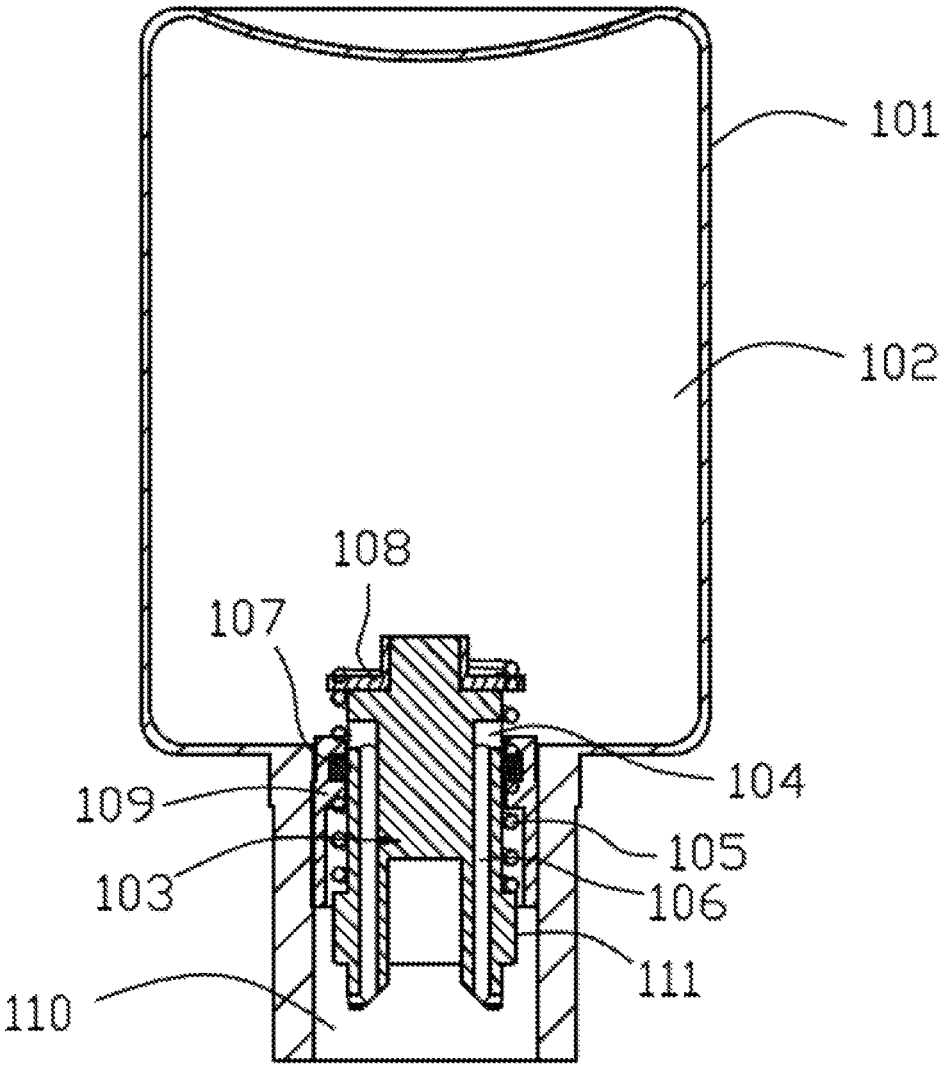
FIG. 2 is a cross-sectional view of the liquid injecting container of FIG. 1, when the liquid outlet is opened.
Figure 4:
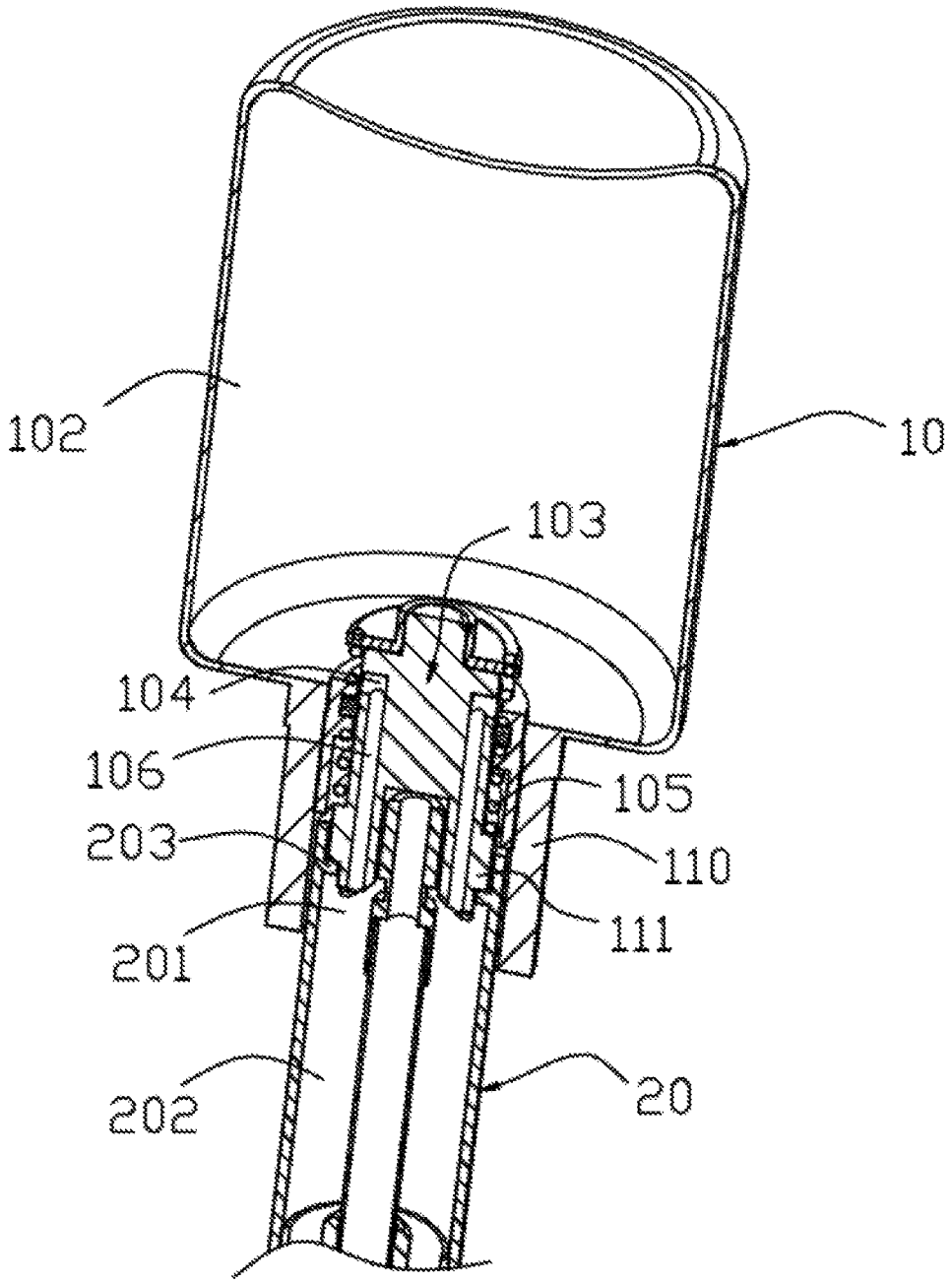
FIG. 4 is a cross-sectional view of the liquid injecting container when coupling with an atomizer of an electronic cigarette.

Referring to FIGS. 2 and 4, the atomizer 20 includes a liquid chamber 202, and the liquid chamber 202 defines a liquid injecting opening 201 at a top end. The liquid chamber 202 includes a protruding stage 203 configured for coupling with the flange 111 of the movable piece 103. When the liquid injecting opening 201 is connected with the open end 110, the inserting part 1032 inserts into the liquid injecting opening 201, the protruding part 203 abuts against the lower surface 113, and drives the movable piece 103 to move upwards. When the movable piece 103 is moved upwards, the liquid outlet 104 moves beyond the sealing component 107, and communicates with the reservoir 102. Accordingly, the tobacco liquid in the reservoir 102 can flow into the liquid chamber 202 of the atomizer 20. It is noted that, to further improve liquid leakage, the open end 110 of the liquid injecting container 10 and the atomizer 20 may be coupled detachably, for example, in a snap-fit connection.

Quite usefully, the housing 101 of liquid injecting container 10 is made of deformable material, for example, flexible plastic. During liquid injection process, by squeezing the housing 101, tobacco liquid can be filled into the atomizer 20 quickly. An air gap is defined between an outer wall of the atomizer 20 and the inner wall of the open end, so that air can be expelled via the air gap when injecting liquid. After finishing liquid injection, the top end of the atomizer 20 is pulled out from the open end 110, the movable piece 103 is driven by the elastic piece 105 to move downwards, the liquid outlet 104 returns to an original position below the sealing component 107. In this position, the liquid outlet 104 is sealed again, as seen in FIG. 1.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. A liquid injecting container for an atomizer of an electronic cigarette, the atomizer including a liquid injecting opening, the liquid injecting container comprising:

a housing defining a reservoir for storing tobacco liquid, the housing having an open end configured for connecting with the liquid injecting opening, the open end defining at least one liquid outlet;

a holder disposed inside the opening end;

a movable piece disposed in the holder and further received in the open end, and being capable of moving along an axial direction of the open end; and an elastic piece disposed in the open end, a first end of the elastic piece abutting against a first end of the movable piece, a part of the elastic piece abutting against the holder, and a second end of the elastic piece opposite to the first end of the elastic piece further connected to a second end of the movable piece;

wherein when the open end is coupled to the liquid injecting opening, the movable piece is capable of moving axially to a first position where the at least one liquid outlet is opened and the part of the elastic piece between the holder and the second end of the elastic piece is stretched while the other part of the elastic piece between the holder and the first end of the elastic piece is not stretched; when the open end is detached from the atomizer, the elastic piece is capable of driving the movable piece via restoration of the part and the other part of the elastic piece to move axially to a second position where the at least one liquid outlet is sealed.

2. The liquid injecting container according to claim 1, wherein the at least one liquid outlet is defined in an upper part of a sidewall of the movable piece, the movable piece defines at least one liquid passage extending axially, and the liquid passage is in communication with the at least one liquid outlet.

3. The liquid injecting container according to claim 2, further comprising a sealing component between the movable piece and the open end, wherein the sealing component is configured for sealing the at least one liquid outlet, when the movable piece is moved upwards beyond the sealing component, the at least one liquid outlet communicates with the reservoir.

4. The liquid injecting container according to claim 3, wherein the sealing component comprises a sealing ring, and the sealing ring is assembled in the holder.

5. The liquid injecting container according to claim 2, wherein the movable piece comprises a main body and at least one inserting part extending from the main body, the at least one inserting part is configured for inserting into the liquid injecting opening, and the at least one liquid passage extends through the at least one inserting part.

6. The liquid injecting container according to claim 1, wherein the elastic piece comprises a spring.

7. The liquid injecting container according to claim 6, further comprising a locating plate arranged on the second end of the movable piece, wherein the second end of the spring is connected to the locating plate.

8. The liquid injecting container according to claim 1, wherein the movable piece comprises a flange on a sidewall at the first end of the movable piece, and the flange comprises a bottom surface configured for abutting against the atomizer.

9. The liquid injecting container according to claim 8, wherein the first end of the elastic piece abuts against a top surface of the flange.

10. The liquid injecting container according to claim 1, wherein the housing is made of deformable material.

* * * * *